United States Patent [19]

La Mar

[11] 4,083,450

[45] Apr. 11, 1978

[54] PIPE-TAPE SPOOL

[76] Inventor: Ridge L. La Mar, 628 Harrison, Douglas, Wyo. 82633

[21] Appl. No.: 744,032

[22] Filed: Nov. 22, 1976

[51] Int. Cl.[2] ..... B65D 85/676; B65H 75/14

[52] U.S. Cl. ..... 206/416; 242/1; 242/71.8; 242/115; 242/118.62

[58] Field of Search ..... 242/118.62, 118.61, 242/118.4, 118, 115, 71.8, 77, 129, 68.5, 68.6, 54 R, 55, 1; 206/413, 414, 415, 416, 407, 389

[56] References Cited

U.S. PATENT DOCUMENTS

| | | | |
|---|---|---|---|
| 407,583 | 7/1889 | Ehret, Jr. | 242/118.62 |
| 415,423 | 11/1889 | Smith | 242/71.8 |
| 2,499,989 | 3/1950 | Cramer | 242/118.62 |
| 2,737,291 | 3/1956 | Rochestie | 206/416 |

FOREIGN PATENT DOCUMENTS

| | | | |
|---|---|---|---|
| 613,641 | 12/1948 | United Kingdom | 242/118.62 |

*Primary Examiner*—George F. Mautz
*Attorney, Agent, or Firm*—Trask & Britt

[57] ABSTRACT

A spool for storing tape for taping large underground pipe is disclosed. The spool is capable of being disassembled for use in removing a roll of pipe tape. The spool is of rugged construction since the tape is not unrolled from the spool, but removed as a roll which often requires force to be applied to the spool to cause the spindle of the spool to slip from the center of the roll.

6 Claims, 5 Drawing Figures

PIPE-TAPE SPOOL

BACKGROUND OF INVENTION

1. Field

This invention relates to spools for storing wide, heavy-duty tape so that said roll is not damaged in storage and the roll can be readily removed intact from said spool.

2. Prior Art

The wide, thick tape used for wrapping underground pipe to prevent corrosion typically comes upon a hollow cardboard core. The roll of tape, including core, is placed upon the spindle of a tape wrapping machine. Frequently, however, the roll of tape is damaged or the roll is subjected to extreme temperature variations which cause the tape to expand and contract, often causing the roll to bulge at a side, rendering it unuseable on the tape wrapping machine.

Although the use of any types of spools with pipe tape is unknown to the inventor, the spools commonly available for other purposes have shortcomings for the purpose of storing pipe tape thereon.

Paper or cardboard spools have insufficient flange strength to be useful. Also, such spools can't be readily disassembled so the tape and core can be removed for insertion upon a tape machine.

Other spools, such as those described in U.S. Pat. Nos. 3,025,021 and 2,546,253 would not be particularly adaptable as spools for pipe tape. The hub portion of the spool shown in McCluer et al, U.S. Pat. No. 3,025,021, has hubs with central openings to admit axles. The spool of McCluer is intended to be rotated to receive thread. The spool'does not appear to have features facilitating disassembly nor features for allowing an axial force to be applied through the tubular spindle.

The spool illustrated in Beauregard, U.S. Pat. No. 2,546,253, shows a collapsible spool having a key running the length of the spindle. The end flanges have a hub portion protruding towards the spindle so that the inner face of the flange is not planer. The spool does not have means for facilitating disassemble nor means for dislodging a roll from the spool.

OBJECTS OF THE INVENTION

It is an object of the instant invention to provide a spool for storing pipe tape in undamaged condition.

Another object of the invention is to provide a spool which can be readily disassembled to remove the roll of tape.

A further object of the instant invention is to provide a spool having solid end members in its flanges.

DESCRIPTION OF INVENTION

A readily disassembled spool for storing pipe tape in undamaged condition has been invented. The spool is of rugged construction, preferably of steel, heavy duty aluminum or strong reinforced plastic.

The spindle of the spool is a hollow tubular member having a heavy duty wall and internally threaded on each end. The end flanges are each a disk-shaped member having a central hub member protruding from the interior of the disk. The hub has a closed end. The hub is cup shaped having an opening into the interior of the hub through an opening in the flange member. The opening into the hub preferably has a bar thereacross to provide means to unscrew one or both flanges from the tubular spindle.

Figure 1:
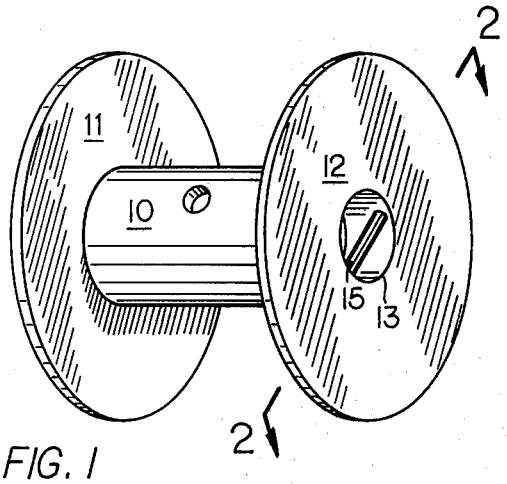
FIG. 1 is a perspective view of the spool of the invention.

Further description of the invention may be faciliated by reference to the drawings wherein FIG. 1 is a perspective view of the spool showing the spindle 10 between a pair of flanges 11 and 12. Flange 12 has an opening 13 into the interior of hub member 14 (see FIG. 3) with a heavy duty bar 15 across said opening.

Figure 2:
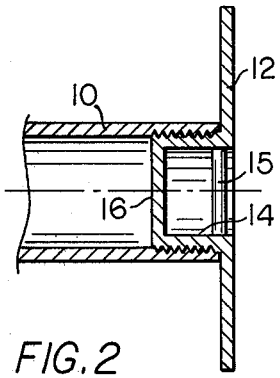
FIG. 2 is a cross-sectional view of the spool of FIG. 1 along section lines 2—2.

In FIG. 2 one end of the spindle and one flange member are illustrated in cross-section. The other end of the spindle and other flange are identical in construction.

The flat faced flange 12 has a heavy duty bar 15 across the opening 13 (see FIG. 1) into the cavity of the hub member 14. The hub 14 has a closed end 16 sufficiently strong that it can be struck with a bar passed axially through the spindle 10 (after one flange has been removed) so that the spindle and remaining flange may be driven from the roll of pipe tape.

The tape is wound tightly onto the spindle of the spool with the spool in assembled form. The roll of tape must be removed from the spool to be used on a pipe wrapping machine. Since the tape is tightly wrapped on the core to get the maximum length of tape onto the core, the roll of tape generally does not slide off the spindle easily. The outside diameter of the spindle must closely approximate the inside diameter of the hollow core, otherwise the core may be compressed through contraction, e.g., cramped in a particular area of the tape, making it impossible to fit the hollow core over the spindle of a tape machine. The roll of tape is removed by placing a support between the roll and the flange and placing a bar axially through the spindle against the closed end of the hub so that flange and spindle may be driven from the roll.

Figure 4:
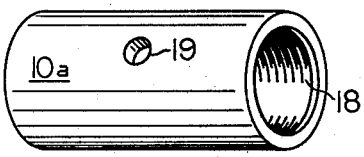
FIG. 4 is a perspective view of the spindle member of FIG. 1.
Figure 3:
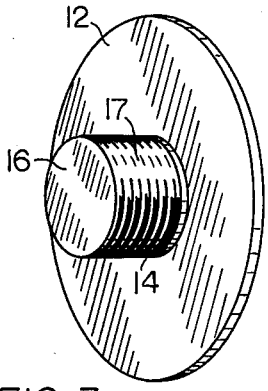
FIG. 3 is a perspective view of a flange member of the spool showing the enclosed hub.

As illustrated in FIGS. 3 and 4, the hub 14 has external threads 17 and the spindle **10*a* has internal threads 18**. This construction is preferred for the instant invention so that damage to threads is substantially eliminated whenever a bar is passed axially through the spindle. Also, this thread arrangement allows the spindle ends to butt substantially against the inside surfaces of the flange members. Thus, the spool has a smooth, even cylindrical surface between the inside of the flange faces.

The spindle **10*a* has a central lateral opening 19** through the midsection of the spindle to accommodate a bar being passed therethrough so that the spindle may be unscrewed from one of the flanges.

Figure 5:
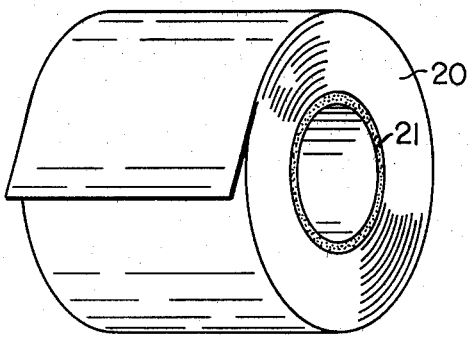
FIG. 5 is a perspective view of a roll of pipe tape to be stored by the spool.

A typical roll of pipe tape is illustrated in FIG. 5 wherein the tape 20 is wound tightly about a hollow paper core 21. The diameter of a typical roll of tape is from about 11 to about 13 inches. The width of the tape is typically from about 1 to about 16 inches. The tape comes in various widths; 1, 2, 4, 6, 9, 12 and 16 inches are common widths.

The core opening of a typical roll of pipe tape is about 3 inches in diameter. A typical outside diameter for the spindle of the spool of this invention is about $2\frac{7}{8}$ inches. The spindle is preferably about ⅛ inch less in diameter than the core opening. The spindle diameter must closely approximate the inside diameter of the core opening of the roll to provide proper support for the roll.

As can be seen in FIG. 5, the roll of tape has no lateral support or protection. The tape may be damaged in shipment or storage. If the tape is badly crimped or cut or the roll is substantially distorted laterally the roll can not be used on the pipe wrapping machine. Also, cyclical expansion and contraction of the tape upon exposure to hot and cold conditions frequently causes the tape to bulge at the sides (distend laterally) so that it cannot be used on the pipe wrapping machine.

The instant invention provides effective means for holding a roll of tape so that it won't be damaged in shipment or become distorted due to extreme variations in temperature during storage. A roll of tape (including the hollow core) is placed over the spindle 10 after one flange has been removed. The spool may then be completely disassembled for return to the supplier so that it may be used again.

The shape of the spool of the instant invention is particularly advantageous inasmuch as the outside surfaces of the flanges are flat without any protrusions so that the spools may be readily stacked upon one another to faciliate storage. Thus, it is preferred to have bar 15 flush with or slightly recessed from the external flange surface 12.

The construction of the instant spool must be sufficiently strong to prevent damage to tape therein and to provide sufficient flange strength to prevent lateral distortion. Various plastics such as polyesters, epoxies, polyurethanes, acrylonitrile-butadiene-styrene, polyvinylchloride resins and the like may be used. Metal construction of aluminum, steel and the like may also be used.

The spool of this invention is intended to be used to store rolls of tape thereon. The tape is generally in the form of a roll wound upon a hollow core before it is placed upon the spool. The spindle of the spool must be the proper length, i.e., about the width of the tape so that the inside surfaces of the flanges are in close proximity to the sides of the rolls.

The spool provides means for gripping the flanges so that one flange may be unscrewed from the spindle.

I claim:

1. A disassemblable spool for holding pipe tape comprising:

a. a tubular spindle having internal thread at each end, b. a pair of flat, disk-shaped flange members having a central cup-shaped hub with external threads, said external threads adapted to mate with the internal threads of said spindle, said cup-shaped hub having a solid end and a bar across the opening formed by the cavity of the cup-like hub, said bar being substantially in the same plane as said flat disk-shaped flange members, said flange members having a diameter about three-fold that of the spindle.

2. The spool of claim 1 wherein said tubular spindle is constructed of metal or plastic with a heavy duty wall and heavy duty threads.

3. The spool of claim 1 wherein the disk-shaped flange members are constructed of a heavy duty metal or plastic material.

4. The spool of claim 1 wherein said cup-like hub member is threaded substantially completely so that the inside of said flange disks substantially butt against the end of said spindle.

5. The spool of claim 1 wherein said spool has a solid end of sufficient sturdiness to provide a striking surface.

6. The spool of claim 1 wherein said opening to said cup-shaped cavity is sufficiently wide to insert a tool over said bar to twist same.

* * * * *